US006003355A

United States Patent [19]

Yasuda et al.

[11] Patent Number: 6,003,355

[45] Date of Patent: Dec. 21, 1999

[54] ROLLING MILL AND ROLLING METHOD

[75] Inventors: Kenichi Yasuda, Hitachinaka; Yukio Hirama, Mito; Yoshio Takakura, Hitachi, all of Japan

[73] Assignee: Hitachi, Ltd., Japan

[21] Appl. No.: 09/028,248

[22] Filed: Feb. 24, 1998

[30] Foreign Application Priority Data

Feb. 24, 1997 [JP] Japan ..... 9-038909

[51] Int. Cl.[6] ..... B21B 29/00

[52] U.S. Cl. ..... 72/243.4; 72/241.8; 72/14.5

[58] Field of Search ..... 72/241.2, 241.8, 72/243.2, 243.4, 243.6, 13.4, 14.5

[56] References Cited

U.S. PATENT DOCUMENTS

| | | | |
|---|---|---|---|
| 4,552,008 | 11/1985 | Schlatter et al. | 72/243.2 |
| 4,712,416 | 12/1987 | Rommen et al. | 72/249 |
| 5,406,817 | 4/1995 | Takakura et al. | 72/243.4 |
| 5,560,237 | 10/1996 | Yasuda et al. | 72/243.2 |

FOREIGN PATENT DOCUMENTS

| | | | |
|---|---|---|---|
| 60-18211 | 1/1985 | Japan | 72/243.2 |
| 61-19708 | 8/1986 | Japan | 72/243.2 |
| 2-147108 | 6/1990 | Japan | 72/243.2 |

*Primary Examiner*—Joseph J. Hail, III
*Assistant Examiner*—Ed Tolan
*Attorney, Agent, or Firm*—Evenson, McKeown, Edwards & Lenahan, P.L.L.C.

[57] ABSTRACT

To provide a rolling mill in which work rolls being supported horizontally by static pressure bearings wherein, even under the action of an excessive horizontal force, preventing contact between the work rolls and the static pressure bearings to ensure the production of a strip product free of flaw and superior in its surface quality. Work rolls are supported by static pressure bearings through idler rolls. The amount of offset of the work rolls are changed respectively by moving devices through static pressure bearings. Further, pushing cylinders generate a certain force through the static pressure bearings to bear the force provided from the moving devices.

28 Claims, 12 Drawing Sheets

ROLLING MILL AND ROLLING METHOD

BACKGROUND OF THE INVENTION

1. Field of the Invention

The present invention relates to a rolling mill and rolling method for rolling a plate. Particularly, the invention is concerned with a rolling mill and rolling method using work rolls of a small diameter and suitable for rolling a hard or ultra-thin strip.

2. Description of the Prior Art

Heretofore, working rolls of a small diameter have been used for rolling a hard or ultra-thin strip such as stainless steel strip. With a decrease in diameter of the work rolls, the flexural rigidity of the rolls becomes lower inevitably. Particularly, deflection in a horizontal plane poses a problem. This horizontal deflection causes a more marked disturbance in the shape (flatness) of the strip used. The horizontal deflection sometimes exceeds the correction capacity of a shape correcting device such as the work roll bender which has heretofore been used. If the rolls deflect vertically in opposite directions, the central portions of the upper and lower work rolls undergo forces acting in opposite directions, which forces promote the vertical opposite deflections in an accelerative manner. In this case, if the rolling load is set large, the rolls may be broken. In order to prevent the occurrence of such a trouble, the application of a large load must be avoided.

In view of the above points, there have been developed Cluster mill type rolling mills, including Sendzimir mill, as well as a rolling mill having a horizontal deflection preventing mechanism wherein the drum portions of work rolls are supported horizontally with support rolls such as that disclosed in Japanese Patent Laid Open No.18206/85. In these rolling mills, however, since the support rolls are divided in the direction of the roll drum length, the surface properties of the plate rolled are deteriorated due to mark transfer by the divided support rolls.

As a rolling mill which takes into account the prevention of such deterioration in the plate surface properties and which permits the use of work rolls of a small diameter, there has been developed such a rolling mill as disclosed in Japanese Patent Laid Open No.50109/93. In this rolling mill, horizontal support rolls are mounted outside the area through which the maximum width of the strip to be rolled passes, then a horizontal deflection of each work roll is detected and a horizontal bending force of the roll is controlled so that the horizontal deflection thereof becomes equal to zero. At the same time, the work rolls are each moved to a position where the horizontal force which causes the horizontal deflection is zero. Since a horizontal support device for the strip is not present in the area where the strip passes, it is possible to prevent the deterioration of surface properties attributable to such horizontal support device.

In the rolling mill disclosed in the above unexamined publication 50109/93, however, a limit has so far been encountered in reducing the diameter of each work roll. More particularly, if the work roll diameter is set below a certain value, the flexural rigidity becomes extremely low, and the responsivity in horizontal deflection control also encounters a limit, resulting in that it becomes no longer possible to make the horizontal deflection zero. Actually, in the rolling mill of the type described in the above unexamined publication, it is considered that a roll diameter of 10% or so of the maximum strip width is the limit in reducing the roll diameter. It has been difficult to make the roll diameter still smaller.

For the simplification of a rolling mill and for the reduction in diameter of working rolls, a rolling mill having a support mechanism which prevents the deflection of work rolls on an incoming side of the rolls is disclosed in Japanese Patent Laid Open No.94509/84. The support mechanism is provided with a cooling means using adjustment of liquid pressure to prevent friction caused by the support. Each work roll is provided with a shifting mechanism so as to adapt itself to changes in rolling conditions (for example the plate to be rolled). According to such a technique, the deflection of work rolls can be prevented to some extent, but no consideration is given to diminishing the horizontal force. Besides, since the shifting mechanism is provided on the work roll itself, the deflection of the work roll is influenced by a shifting motion. It has so far been difficult to effect shifting while minimizing the deflection of each work roll.

Further, as a rolling mill suitable for preventing the foregoing deterioration of the strip surface properties and for attaining a further reduction in diameter of work rolls, a rolling mill provided with a horizontal support mechanism for work rolls, using static pressure bearings, is disclosed in Japanese Patent Publication No.13366/96. This rolling mill is constructed schematically as in FIG. 17 for example. As shown in the same figure, work rolls 102 and 103 for rolling a strip 101 are supported vertically by means of intermediate rolls 104,105 and back up rolls 106,107 and are supported horizontally by means of static pressure bearings 112,113, 114 and 115 through idler rolls 108,109,110 and 111.

In the rolling mill disclosed in the Japanese patent publication 13366/96 such as that shown as an example in FIG. 17 in which the work rolls 102 and 103 are supported horizontally by means of static pressure bearings 112,113, 114 and 115, there have been the following points to be further improved.

In the rolling mill shown in FIG. 17, the work rolls 102 and 103 are mounted centrally of the rolling mill. On the other hand, where the work roll diameter is reduced, it is impossible to drive the work rolls directly because a high strength of their driving shafts is to be ensured. It is unavoidable for the working rolls to be driven indirectly through back up rolls or intermediate rolls. Consequently, a tangential force acting in the horizontal direction is developed at the time of imparting a rolling torque to the work rolls through the back up rolls or the intermediate rolls. Under rolling conditions involving a large torque, the driving tangential force (horizontal force) also becomes large, so that an excessive force is also imposed on the static pressure bearings which bear the force. Therefore, if the fluid pressure fed to the static pressure bearings is not sufficient, it is impossible for the bearings to bear the horizontal force, with the result that the rolls and bearing pads of the static pressure bearings come into contact with each other and both are flawed. The flaws on the work rolls are inevitably transferred onto the strip being rolled, thus deteriorating the strip quality markedly. On the other hand, if the flaws on the bearing pads are left as they are, the fresh rolls after roll replacement will also be flawed. For this reason, it is necessary to replace the bearing pads themselves. This roll replacing work requires much time, thus leading to deterioration of the productivity. Besides, repair of the bearing pads costs much because the bearing pads require a high fabrication accuracy. Thus, the contact between the work rolls and the bearing pads of the static pressure bearings caused by the aforesaid excessive horizontal force results in great damage.

For preventing such an inconvenience as mentioned above, it is necessary to take an appropriate measure, for example, let the oil pressure fed to the static pressure bearings have a margin. To this end, it is inevitably required to use a pump and a tank, resulting in an increase of the equipment cost and of the power cost.

SUMMARY OF THE INVENTION

It is an object of the present invention to provide a rolling mill and rolling method wherein work rolls are supported horizontally by means of static pressure bearings and which, during rolling, can prevent contact between the work rolls and the static pressure bearings even under the action of an excessive horizontal force, thereby affording a rolled product free of flaws and superior in the surface quality.

According to the present invention, in order to achieve the above-mentioned object, there is provided a rolling mill having at least a pair of work rolls for rolling a strip, also having at least a pair of back up rolls for driving the work rolls, and further having static pressure bearings which support side faces of the work rolls horizontally using a fluid pressure over a range not smaller than the maximum width of the strip to be rolled, the static pressure bearings being mounted on both work roll incoming side and outgoing side, characterized in that moving means for moving the work rolls horizontally toward the incoming side and outgoing side are attached to the static pressure bearings.

Thus, in the present invention, moving means are attached to the static pressure bearings to move the work rolls toward the incoming side and the outgoing side, thereby changing the amount of offset of the work rolls. By so doing, a component force of the rolling load, driving tangential force, and front and rear tensions imposed on the plate to be rolled, can be balanced and the total horizontal force exerted on the work rolls can be maintained at an allowable value (a limit value associated with contact between the work rolls and the bearing pads of the static pressure bearings) or less. Consequently, it becomes possible to prevent the work rolls from coming into contact with the bearing pads of the static pressure bearings under the action of an excessive horizontal force.

Preferably, in the present invention, horizontal force measuring means for measuring a horizontal force applied to each static pressure bearing are attached to the static pressure bearings located on at least one of the incoming side and the outgoing side.

Preferably, not only the moving means are attached to the static pressure bearings located on one of the incoming side and the outgoing side, but also pushing force generating means for generating a pushing force which resists the force developed by the moving means are attached to the static pressure bearings located on the other side.

Preferably, there are used floating measuring means for measuring to what degree the rolls supported by the static pressure bearings float relative to the same bearings.

Preferably, feed pressure control means are used to control the fluid pressure to be fed to the static pressure bearings in accordance with the horizontal force measured by the horizontal force measuring means.

Preferably, static pressure bearing control means are used for moving the static pressure bearings to positions where the horizontal force measured by the horizontal force measuring means is of a predetermined value or smaller.

Preferably, moving means control means are used to control the work roll moving means in such a manner as to move the work rolls to positions where the horizontal force measured by the horizontal force measuring means is of the predetermined value or smaller.

According to the present invention, there is also provided a rolling method which comprises measuring the horizontal force applied horizontally to the static pressure bearings by the horizontal force measuring means and, in accordance with the horizontal force thus measured, controlling the force to be generated by the pushing force generating means.

There is also provided a rolling method which comprises measuring the amount of floating of the work rolls relative to the static pressure bearings by the floating measuring means and, in accordance with the amount of floating thus measured, controlling the position of each work roll in the incoming and outgoing direction, or controlling the force to generated by the pushing force generating means, or controlling the fluid pressure to be fed to the static pressure bearings.

In the above construction, for example, when the value of horizontal force applied to the static pressure bearings and measured by the horizontal force measuring means is close to the allowable value, the pushing force created by the pushing force generating means may be set small. For example, moreover, when the value of horizontal force applied to the static pressure bearings and measured by the horizontal force measuring means is close to the value allowable for the same bearings, the fluid pressure fed to the bearings may be increased and the allowable value itself increased.

Further, instead of measuring the horizontal force, there may be adopted a method wherein the amount of floating of the work rolls relative to the static pressure bearings, i.e., the distance between the rolls and bearing pads, is measured by the floating measuring means, and for example when the amount of floating thus measured becomes a certain value or smaller, the position (offset) of the work rolls in the incoming and outgoing direction is changed, or the force developed by the pushing force generating means is decreased, or the fluid pressure fed to the static pressure bearings is increased.

In the rolling mill described above, idler rolls are preferably disposed between the work rolls and the static pressure bearings. With the idler rollers thus disposed, even if the diameter of each work roll is changed by on-line grinding, it is possible to keep high the accuracy of the amount of roll floating and the pushing force relative to the static pressure bearings. Besides, the replacement of work rolls becomes easier.

Preferably, in the static pressure bearings are formed a plurality of fluid feed holes in the plate width direction. The fluid feed holes are preferably varied in diameter in the strip width direction. By so doing, when the working rolls swell in the middle due to thermal expansion, the amount of floating at both end portions in the strip width direction can be increased and hence it is possible to support the rolls uniformly and stably.

According to the present invention, moreover, there is provided a rolling method using the rolling mill described above, which method comprises measuring horizontal forces applied horizontally to the static pressure bearings on both operating side and driving side by the horizontal force measuring means and, in accordance with the difference between the horizontal force on the operating side and that on the driving side, controlling the difference between the fluid pressure fed to the static pressure bearings on the operating side and that on the driving side, or controlling the difference between the force generated by the pushing force generating means on the operating side and that on the driving side.

Further, according to the present invention there is provided a rolling method using the rolling mill described above, which method comprises measuring the amounts of floating of the work rolls relative to the static pressure bearings at least two points in the strip width direction and, in accordance with the difference between the measured amount of floating on the operating side and that on the driving side, controlling the difference between the fluid pressure fed to the static pressure bearings on the operating side and that on the driving side, or controlling the difference between the force generated by the pushing force generating means on the operating side and that on the driving side.

Thus, since the difference in the fluid pressure fed to the static pressure bearings between the operating side and the driving side or the difference in the force generated by the pushing force generating means between the operating side and the driving side is controlled, when an excessive horizontal force is applied to a certain portion in the strip width direction, it is possible to increase the fluid pressure in that portion of a large horizontal force, or the pushing force generated by the pushing force generating means can be diminished at that portion of a large horizontal force to thereby diminish the total horizontal force applied to the static pressure bearings.

BRIEF DESCRIPTION OF THE DRAWINGS

The invention disclosed herein will be understood better with reference to the following drawing of which.

DETAILED DESCRIPTION OF THE PREFERRED EMBODIMENTS

Figure 1:
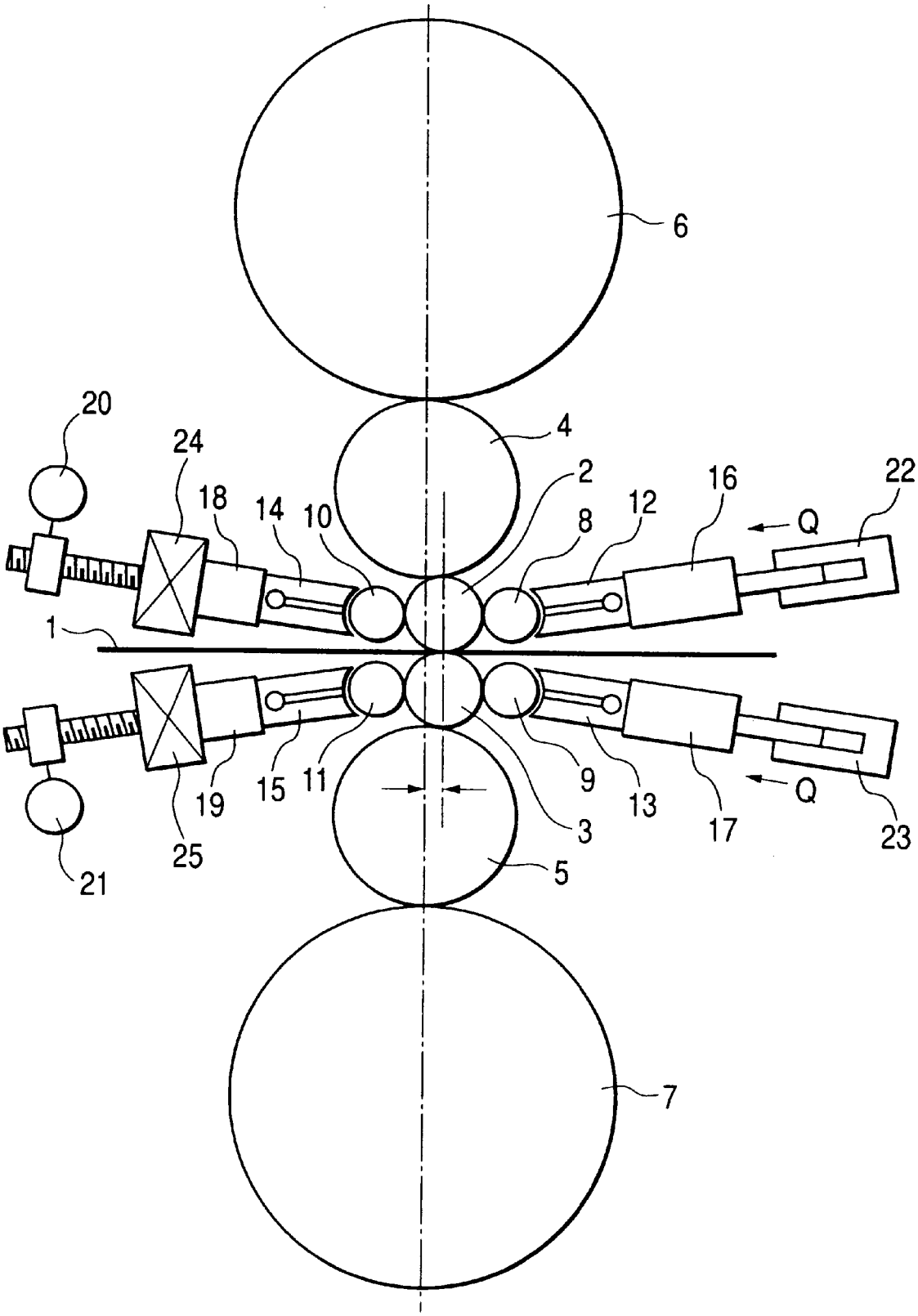
FIG. 1 is a front view of a rolling mill according to the first embodiment of the present invention.

A rolling mill according to the first embodiment of the present invention will now be described with reference to FIGS. 1 to 6. In the rolling mill of this embodiment, as shown in FIG. 1, work rolls 2 and 3 for rolling a plate 1 are supported vertically by intermediate rolls 4,5 and back up rolls 6,7. The intermediate rolls 4 and 5 are connected to a motor (not shown), and the work rolls 2 and 3 are driven by the intermediate rolls 4 and 5. On the other hand, the work rolls 2 and 3 are horizontally supported by static pressure bearings 12,13,14 and 15 through idler rolls 8,9,10 and 11. The static pressure bearings 12 to 15 are respectively mounted to beams 16,17,18 and 19 of sufficient rigidity. The beams (18 and 19 in this embodiment) located on either the incoming side or the outgoing side are respectively provided with moving devices (moving means) 20 and 21 for moving the beams in the incoming and outgoing direction. The moving devices 20 and 21, which are secured to a housing of the rolling mill, are of a structure in which the beams 18 and 19 are moved in the horizontal direction by turning screws. With this structure, the position of the work rolls 2 and 3 in the incoming and outgoing direction with respect to the shafts of the intermediate rolls 4 and 5, i.e., offset "y", can be varied. Since the idler rolls 8,9,10 and 11 are provided, even in the event the work rolls 2 and 3 are changed in diameter by on-line grinding, the amount of floating of the work rolls, as well as pushing force thereof, can be maintained high in accuracy. Besides, the replacement of the work rolls 2 and 3 becomes easy.

Pushing cylinders (pushing force generating means) 22 and 23 are attached to the beams 16 and 17 with the moving devices 20 and 21 not connected thereto, whereby the work rolls 2 and 3 are pushed horizontally with a certain force. The forces applied horizontally to the work rolls 2 and 3 are measured respectively by load cells (horizontal force measuring means) 24 and 25. By setting the amount of offset y of the work rolls 2 and 3 at an appropriate value determined by rolling load, rolling torque, and front and rear tensions, the (total) amount of horizontal forces imposed on the work rolls 2 and 3 can be set equal to zero (or an allowable value close to zero or less).

Figure 2:
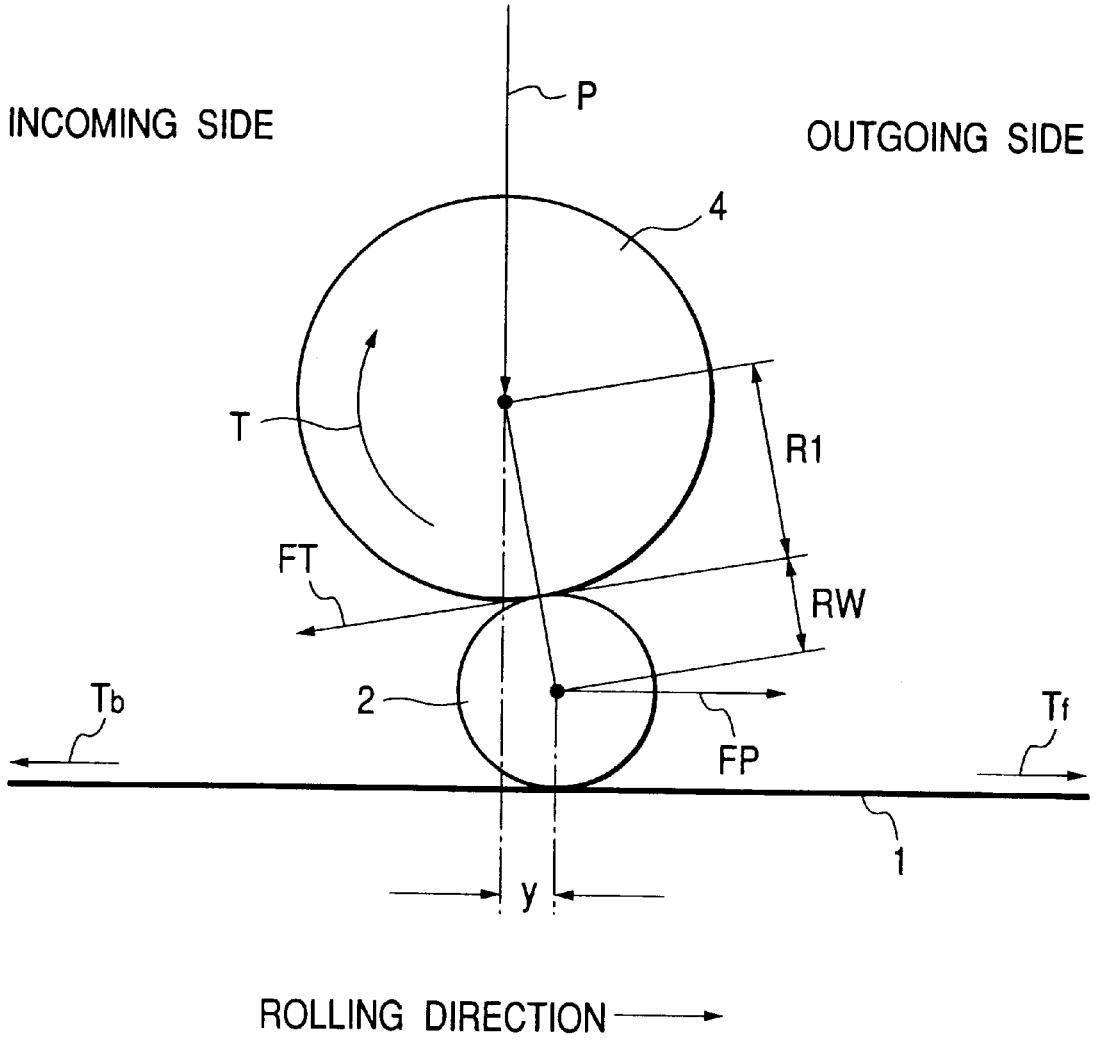
FIG. 2 is diagram explaining how to calculate the amount of offset work rolls.

How to calculate the amount of offset, y, for setting the horizontal forces applied to the work rolls 2 and 3 at a value equal to zero (or an allowable value close to zero or less) will now be described with reference to FIG. 2. The horizontal force, S, applied to the work roll 2 (or 3) is represented by the following equation:

$$S=FT-FP+(Tb-Tf)/2 \quad (1)$$

where Tb stands for an incoming-side tension imposed on the strip 1, Tf stands for an outgoing-side tension imposed on the strip, FT stands for a driving tangential force based on torque T of the intermediate roll 4 (or 5), and FP stands for a horizontal component force of a rolling load P. FT and FP are represented as follows:

$$FT=T/RI \quad (2)$$

$$FP=P\cdot y/(RI+RW) \quad (3)$$

where RI stands for the radius of the intermediate roll 4 (or 5) and RW stands for the radius of the work roll 2 (or 3).

If the horizontal force S in the above equation (1) is set at 0, the amount of offset, y, in this condition is given by the following equation:

$$y=(T/RI+(Tb-Tf)/2)\cdot(RI+RW)/P \quad (4)$$

In the above equation (4), the rolling load P, torque T, and tensions Tb and Tf, can be calculated if rolling conditions are determined. As to the roll diameters RI and RW, they are known inevitably. Therefore, before the start of rolling, an appropriate offset y can be obtained from the equation (4).

Thus, if rolling is started after setting the work rolls 2 and 3 at respective positions offset by the above y to the outgoing side, it is possible to prevent an excessive horizontal force from being applied to the work rolls 2 and 3 by rolling and hence it is possible to prevent an excessive load from being imposed on the static pressure bearings 12 to 15. In addition to the horizontal force S of equation (1) developed by rolling, a pushing force Q generated by the pushing cylinders 22 and 23 is also applied to the static pressure bearings 12 and 13. The pushing force Q is for stabilizing the working rolls 2 and 3 so as not to become unsteady and it is a small force lest damage should be done to the static pressure bearings 12 and 13.

Figure 3:
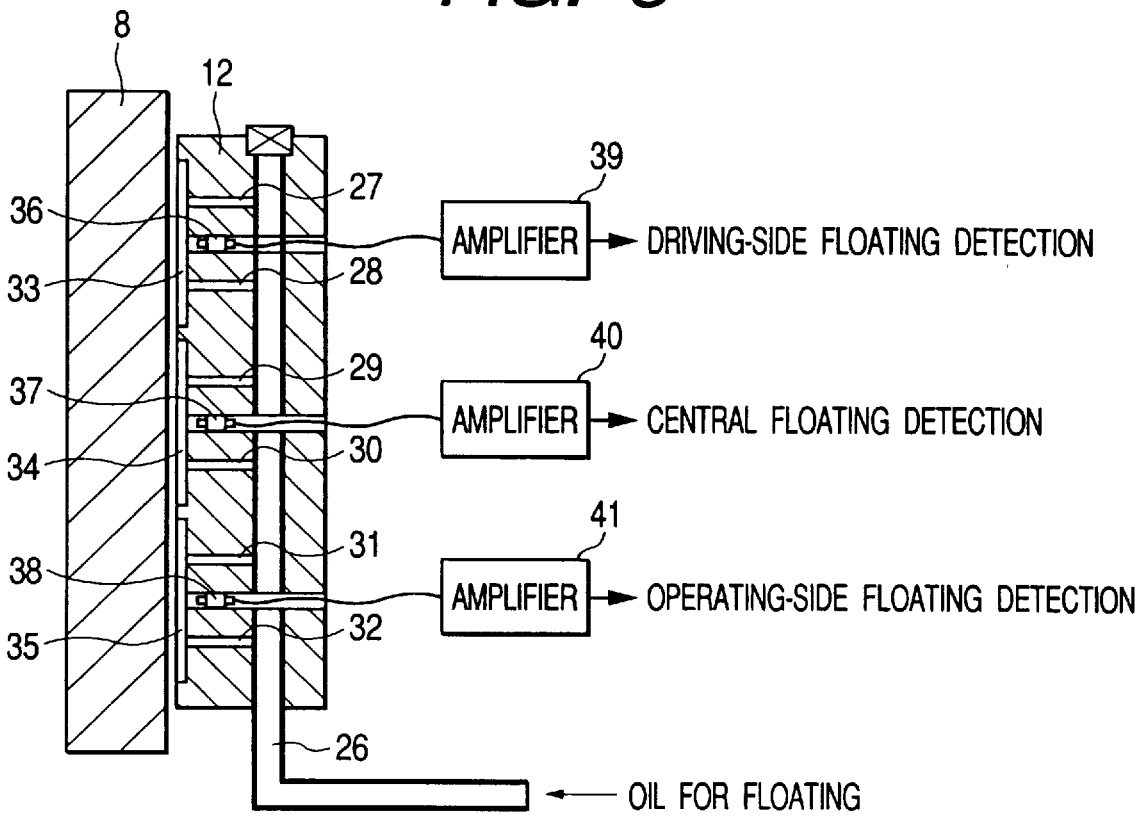
FIG. 3 is a diagram explaining the structure of a static pressure bearing shown in FIG. 1 that is a top view of the bearing.

FIG. 3 is a top view of the static pressure bearing 12. Oil for floating, which is fed from an oil pressure source (not shown), passes through a main oiling hole 26, then through oiling holes 27 to 32 of a small diameter, and further flows into oil pockets 33,34 and 35, causing the roll (idler roll) 8 to float. The amount of floating of the roll 8 is measured by gap measuring devices 36,37 and 38 and the measured values are converted to electric signals respectively by amplifiers 39, 40 and 41. As shown in the figure, the gap measuring devices 36,37 and 38 are used respectively for floating detections on the driving side, central portion and operating side.

Figure 4:
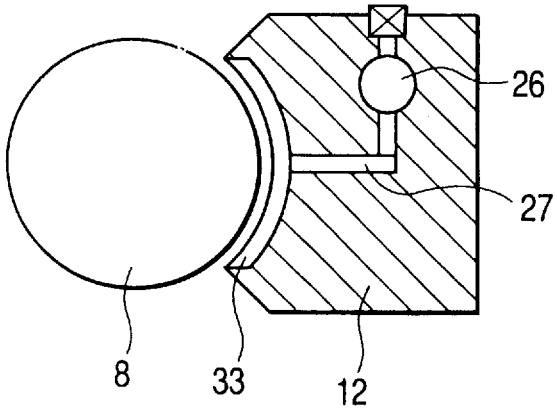
FIG. 4 is a vertical sectional view showing the static pressure bearing at the position of oiling holes.
Figure 5:
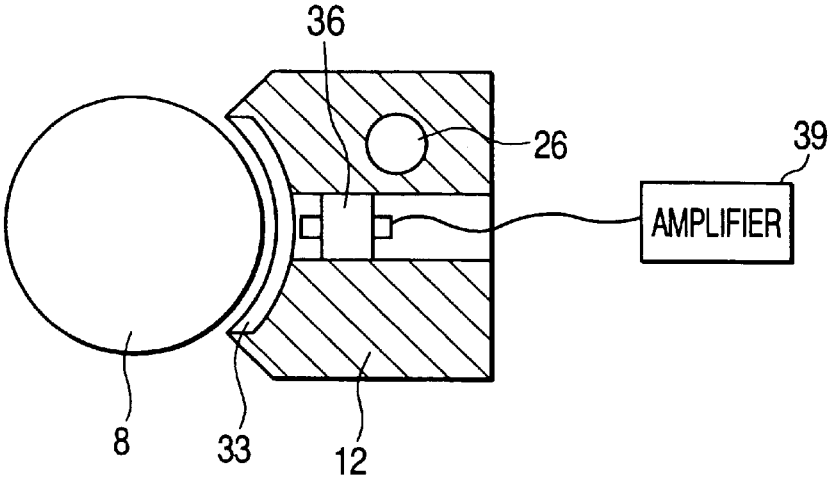
FIG. 5 is a vertical sectional view showing the static pressure bearing at the position of a gap measuring device.

FIG. 4 is a vertical sectional view of the oiling hole 27 and the vicinity thereof, and FIG. 5 is a vertical sectional view of the gap measuring device 36 and the vicinity thereof. The other oiling holes and gap measuring devices are also of almost the same constructions. A large diameter of the oiling holes 27 to 32 results in an increase of flow rate and so does the amount of floating of the roll 8, but the amount of displacement upon exertion of an external force on the roll 8 also becomes large. In other words, the spring constant of the static pressure bearings 12 to 15 becomes smaller. Conversely, if the diameter of the oiling holes 27 to 32 is small, the amount of floating of the roll 8 becomes small, but the spring constant of the static pressure bearings 12 to 15 becomes large. Therefore, it is necessary that the aforesaid characteristics be taken into account in determining the diameter of the oiling holes 27 to 32.

Figure 6:
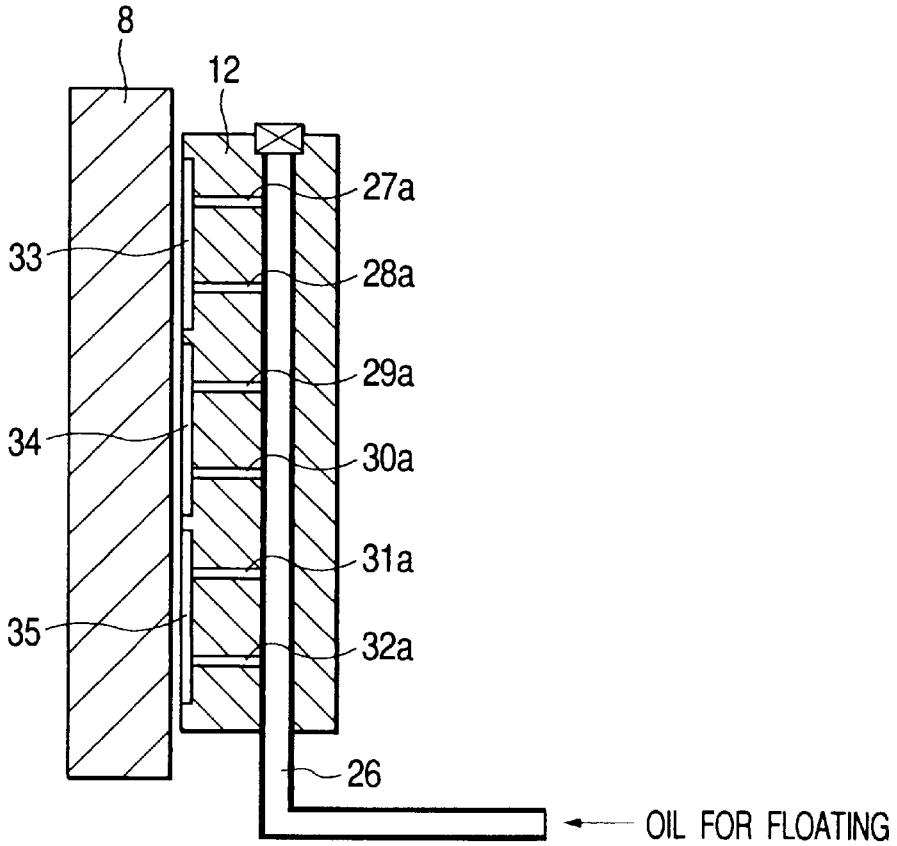
FIG. 6 is a diagram showing an example of a construction having different oiling hole diameters according to positions in the strip width direction.

It is also possible to change the characteristics of the static pressure bearings 12 to 15 intentionally by making the oiling holes 27 to 32 different in diameter according to positions in the width direction of the plate 1. FIG. 6 shows an example thereof, in which oiling holes 27*a*, 28*a*, 31*a* and 32*a* formed in both end portions are larger in diameter than oiling holes 29*a* and 30*a* formed in the central portion. According to this construction, when the central portion swells due to thermal expansion of rolls (work rolls 2,3 and idler rolls 8 to 11), the amount of floating of the work rolls at both end portions in the plate width direction can be increased according to the swelling, whereby the working rolls can be supported uniformly and stably. The structures of the static pressure bearing 12 mentioned above in connection with FIGS. 4 to 6 are common to the static pressure bearings 13~15.

In this embodiment, as described above, since the moving means 20 and 21 are attached to the static pressure bearings 14 and 15 to move the work rolls 2 and 3 in the incoming and outgoing direction, thereby making the amount of offset, y, adjustable, the component force FP of the rolling load P, the driving tangential force FT, and the front and rear tensions Tf, Tb imposed on the plate 1, can be balanced, whereby the total horizontal force S can be maintained to 0 or at less than an allowable value close to 0. Therefore, it is possible to prevent the idler rolls 8 to 11 from coming into contact with the bearing pads of the static pressure bearings 12 to 15 under the action of an excessive horizontal force. Thus, it is possible to always obtain a strip product free from flaws and superior in its surface quality.

Figure 7:
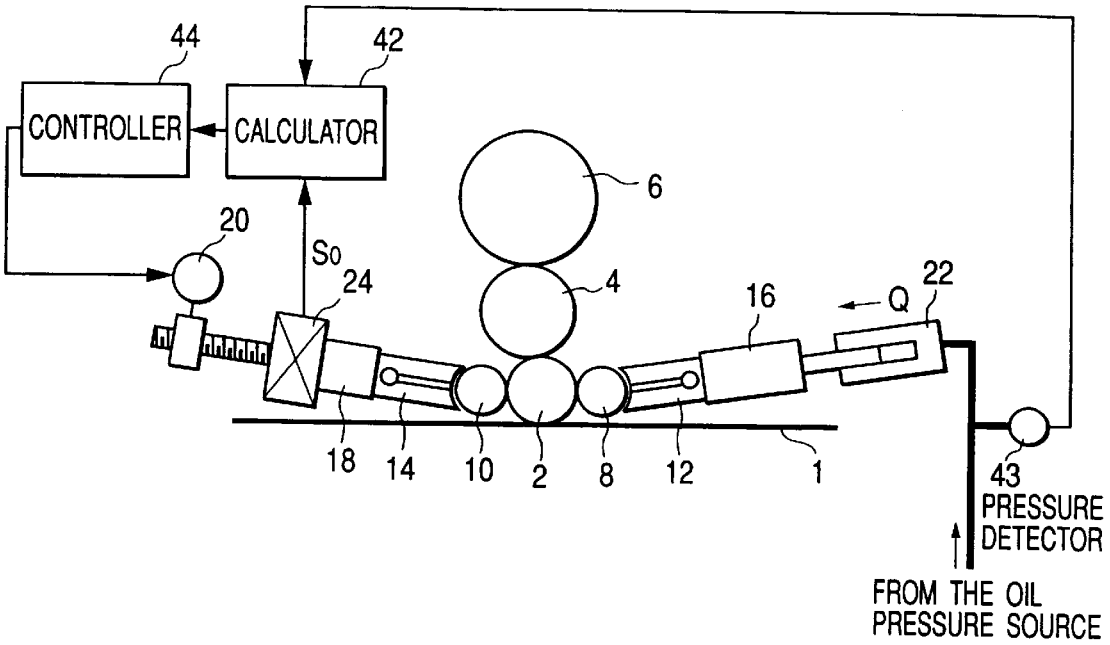
FIG. 7 is a front view showing an upper half of a rolling mill according to the second embodiment of the present invention.

Description is now directed to a rolling mill according to the second embodiment of the present invention. Although only an upper half of the rolling mill will be described, the same is true also of a lower half of the rolling mill (this can be said also of the embodiments which follow). In FIG. 7, the same components as in the preceding figures are indicated by the same reference numerals as in those figures.

In FIG. 7, a horizontal force generated in the work roll 2 in rolling is measured by the load cell 24. The force So detected by the load cell 24 is the sum of the force S of equation (1) and pushing force Q developed by the pushing cylinder 22. That is, the following equation is established:

$$S_0=S+Q \quad (5)$$

The force So detected by the load cell 24 is outputted to a calculator 42, which in turn subtracts the pushing force Q from the detected force in accordance with the above equation (5) to calculate the horizontal force S generated by rolling. The pushing force Q is detected by a pressure detector 43 and is outputted to the calculator 42. However, since the value of Q is usually a constant value, it may be given as a constant to the calculator 42 by means of a setting device provided separately. A controller 44 receives the value S obtained in the calculator 42 and, when S is a positive value, outputs to the moving device 20 a signal for shifting the offset y of the work roll 2 by only a very small amount Δy in the positive direction (rightward in the figure), while when S is a negative value, outputs to the moving device 20 a signal for shifting the offset y by Δy in the negative direction (leftward in the figure). In this way the change of offset using Δy is repeated until S becomes zero. In this case, instead of repeating the shifting until S becomes equal to zero, there may be provided a so-called dead band whereby the change of offset is stopped when the absolute value of S has reached a certain small value or less.

According to this second embodiment described above, not only the same effect as in the first embodiment can be obtained, but also the force applied to the static pressure bearings 12 and 14 can be always maintained within an appropriate range and hence it is possible to prevent the occurrence of flaws in the work roll 2, idler rolls 8,10 and static pressure bearings 12,14.

The third embodiment of the present invention will be described below with reference to FIG. 8, in which the same components as in the figures referred to above are indicated by the same reference numerals as in those figures.

Figure 8:
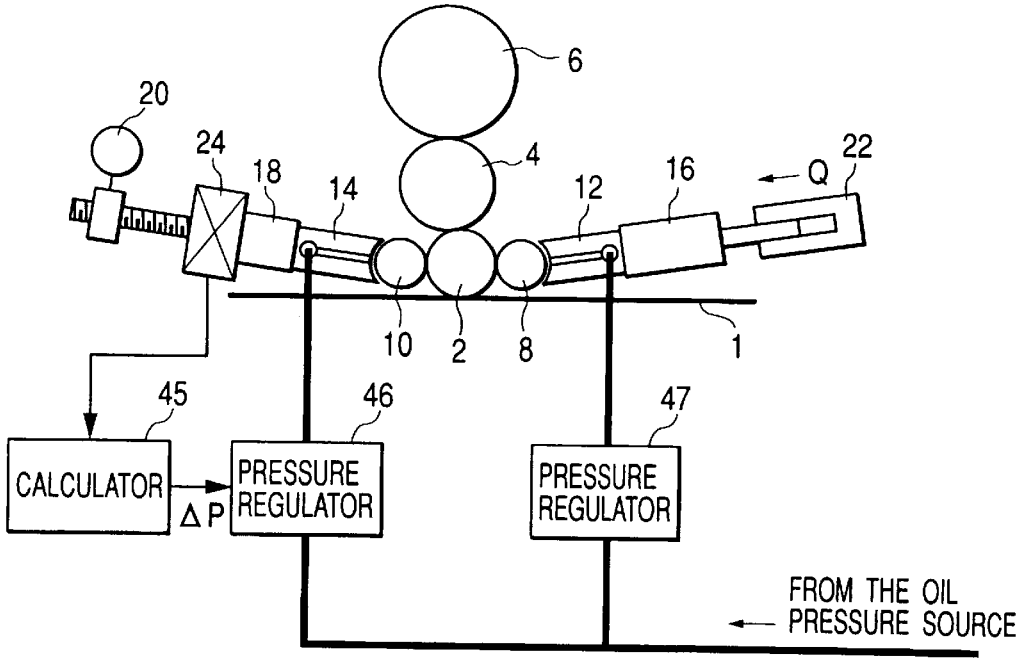
FIG. 8 is a front view showing an upper half of a rolling mill according to the third embodiment of the present invention.

In FIG. 8, a horizontal force applied to the static pressure bearing 14 is measured by the load cell 24. The value of $S_0$ detected by the load cell 24 is fed to a calculator 45, which in turn compares it with a limit pressure resistance value $S_{max}$ of the static pressure bearing 14. When $S_0$ becomes larger than $S_{max}$, the calculator 45 outputs a pressure increasing signal to a pressure regulator 46 disposed in an oil pressure system for floating. The amount of increase in pressure, Δp, is assumed to take the following value which is proportional to an amount exceeding $S_{max}$:

$$\Delta p=\alpha_1(S_0-S_{max}) \quad (6)$$

where $\alpha_1$ is a constant. However, when Δp of equation (6) is negative, the reduction of pressure is not performed. On the other hand, to the static pressure bearing 12 on the pushing cylinder 12 side is fed oil held at a constant pressure by means of a pressure regulator 47. Alternatively, Δp may be a constant value.

According to this third embodiment described above, not only the same effect as in the first embodiment is obtained, but also, when an excessive force is exerted on the static pressure bearing 14, an allowable load of the bearing 14 itself is increased by increasing the oil pressure fed, whereby it is possible to prevent contact and flaws of the roll 10 and the bearing 14. Besides, there is no fear of an excessive force being imposed on the static pressure bearing 12, because the bearing 12 is pushed with a constant force by the pushing cylinder 22.

Now, the fourth embodiment of the present invention will be described below with reference to FIG. 9, in which the same components as in the figures referred to previously are indicated by the same reference numerals as in those figures.

Figure 9:
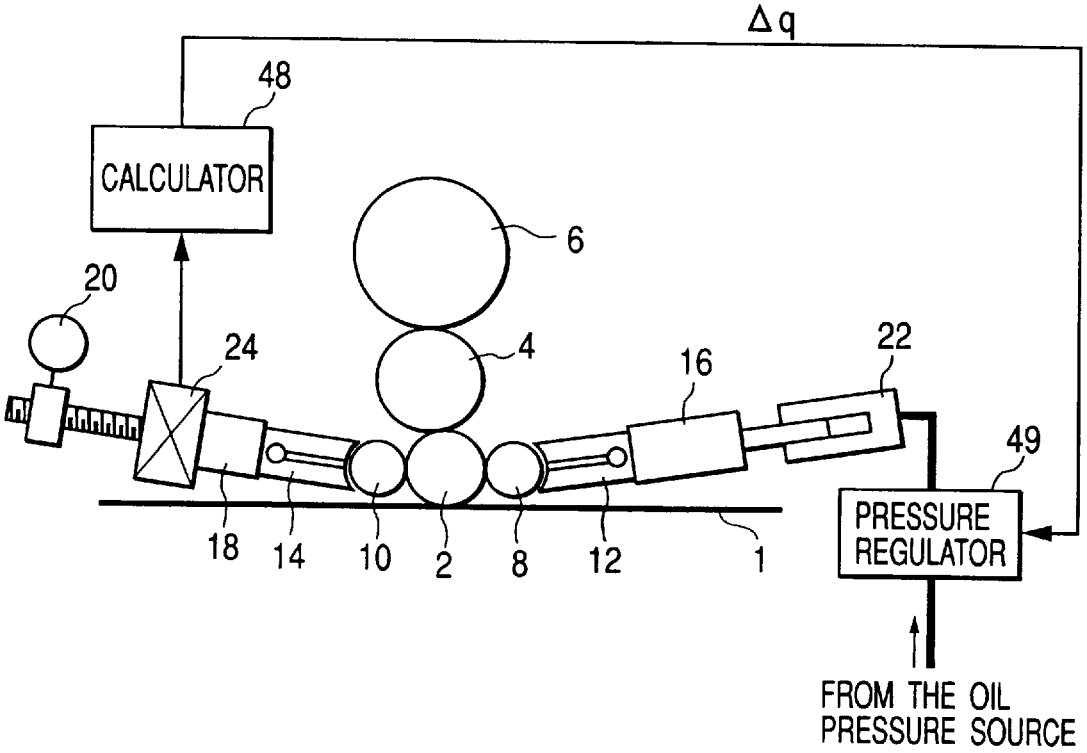
FIG. 9 is a front view showing an upper half of a rolling mill according to the fourth embodiment of the present invention.

In FIG. 9, a horizontal force applied to the static pressure bearing 14 is measured by the load cell 24. The force $S_0$ detected by the load cell 24 is fed to a calculator 48, which in turn compares the force $S_0$ with a limit pressure resistance value $S_{max}$ of the bearing 14. When $S_0$ becomes larger than $S_{max}$, the calculator 48 outputs a pressure reducing signal to a pressure regulator 49 disposed in an oil pressure system for the pushing cylinder 22. The amount of reduction in pressure, Δq, is assumed to take the following value which is proportional to an amount exceeding $S_{max}$:

$$\Delta q=\alpha_2(S_0-S_{max}) \quad (7)$$

where $\alpha_2$ is a constant. However, if the pushing force is zero, the rolls 2,8 and 10 become unstable positionally, so it is necessary that a limit be placed on Δq lest the pushing force should drop to zero or less due to the pressure reduction in equation (7). Alternatively, Δq may take a certain constant value.

According to this fourth embodiment described above, not only the same effect as in the first embodiment is obtained, but also, when an excessive force is applied to the static pressure bearing 14, the horizontal force generated by the pushing cylinder 22 is decreased to diminish the total horizontal force exerted on the bearing 14, whereby it is possible to prevent contact and flaws of the roll 10 and the bearing 14.

Next, the fifth embodiment of the present invention will be described with reference to FIG. 10, in which the same components as in the figures referred to previously are indicated by the same reference numerals as in those figures.

Figure 10:
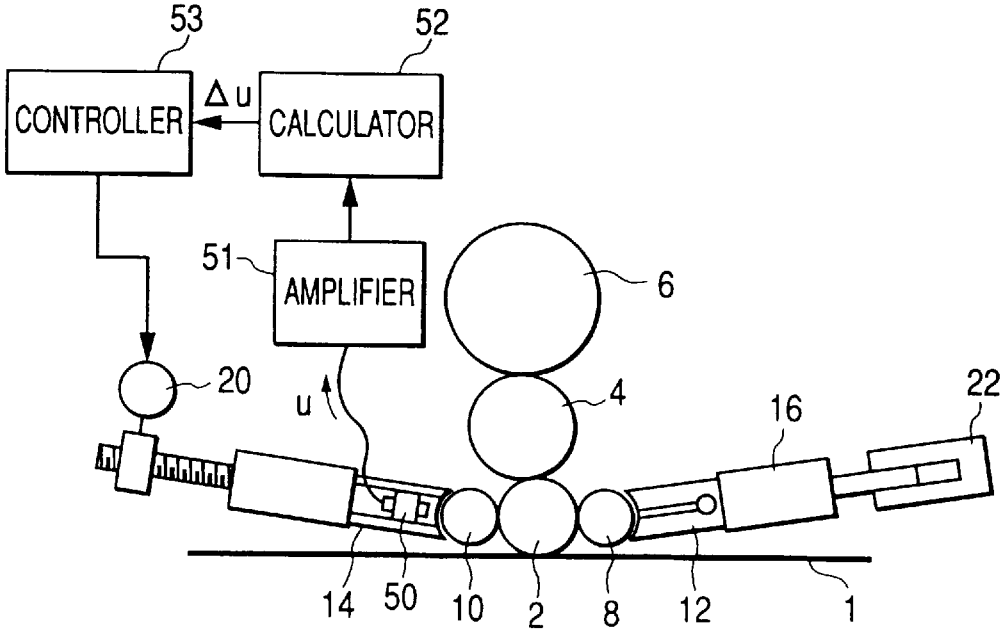
FIG. 10 is a front view showing an upper half of a rolling mill according to the fifth embodiment of the present invention.

In FIG. 10, the amount of floating, u, of the idler roll 10 in rolling is measured by means of a gap measuring device (floating measuring means) 50 disposed within the static pressure bearing 14 and the measured value is converted to an electric signal by an amplifier 51. The value u thus detected is outputted to a calculator 52, which in turn calculates a difference Δu from the amount of floating, $u_0$, which serves as a reference value, in accordance with the following equation:

$$\Delta u=u-u_0 \quad (8)$$

A controller 53 receives the value Δu obtained by the calculator 52 and, when Δu is a negative value, indicating an excessive horizontal force, outputs to the moving device 20 a signal for shifting the offset y of the working roll 2 in the positive direction (rightward in the figure) by only a very small amount Δy, while when Δu is a positive value, indicating a small horizontal force, outputs to the moving device 20 a signal for shifting the offset y in the negative direction (leftward in the figure) by only Δy. In this way the change of offset using Δy is repeated until Δu becomes zero. Instead of repeating the shifting until Δu becomes zero, there may be provided a so-called dead band whereby the change of offset is stopped when the absolute value of Δu has reached a certain small value or less.

According to this embodiment described above, not only the same effect as in the first embodiment is obtained, but also the amount of floating of the roll 10 relative to the static pressure bearing 14 can be kept to a value within an appropriate range and hence it is possible to prevent flaws of the working roll 2, idler rolls 8,10 and static pressure bearings 12,14.

Now, the sixth embodiment of the present invention will be described below with reference to FIG. 11, in which the same components as in the figures referred to previously are indicated by the same reference numerals as in those figures.

Figure 11:
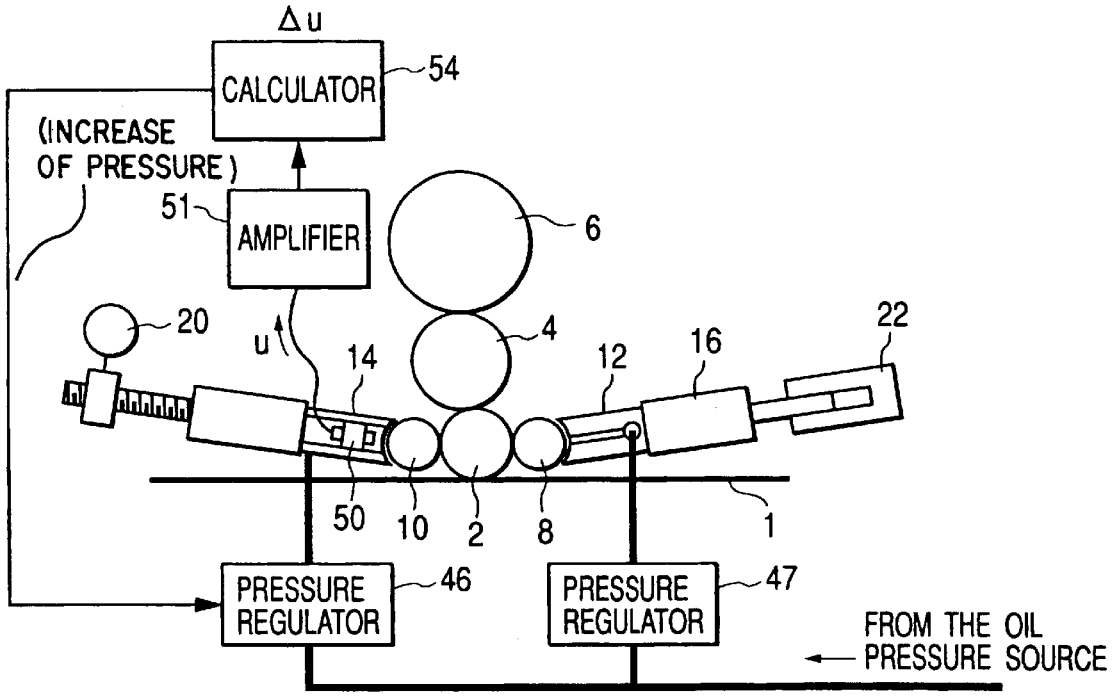
FIG. 11 is a front view showing an upper half of a rolling mill according to the sixth embodiment of the present invention.

In FIG. 11, the amount of floating, u, of the idler roller 10 in rolling is measured by the gap measuring device 50 disposed within the static pressure bearing 14 and the measured value is converted to an electric signal by the amplifier 51. The value u thus detected is outputted to a calculator 54, which in turn calculates a difference Δu from the amount of floating, $u_0$, which serves as a reference value, in accordance with the foregoing equation (8). When Δu is a negative value, this indicates that the horizontal force is excessive, so the calculator 54 outputs a pressure increasing signal to the pressure regulator 46 disposed in the oil pressure system for floating. The amount of increase in pressure, Δp, is assumed to take the following value proportional to Δu:

$$\Delta p=\alpha_3\cdot\Delta u \quad (9)$$

where $\alpha_3$ is a constant. Alternatively, Δp may be a certain constant value. However, when Δu equation (9) is a positive value, the reduction of pressure is not performed. On the other hand, to the static pressure bearing 12 on the pushing cylinder 22 side is fed oil held at a constant pressure by means of the pressure regulator 47.

According to this sixth embodiment described above, not only the same effect as in the first embodiment is obtained, but also, when an excessive force is exerted on the static pressure bearing 14, the allowable load of the bearing 14 itself is increased by increasing the oil pressure fed, whereby it is possible to prevent contact and flaws of the roll 10 and the bearing 14.

Next, the seventh embodiment of the present invention will be described below with reference to FIG. 12, in which the same components as in the figures referred to previously are indicated by the same reference numerals as in those figures.

Figure 12:
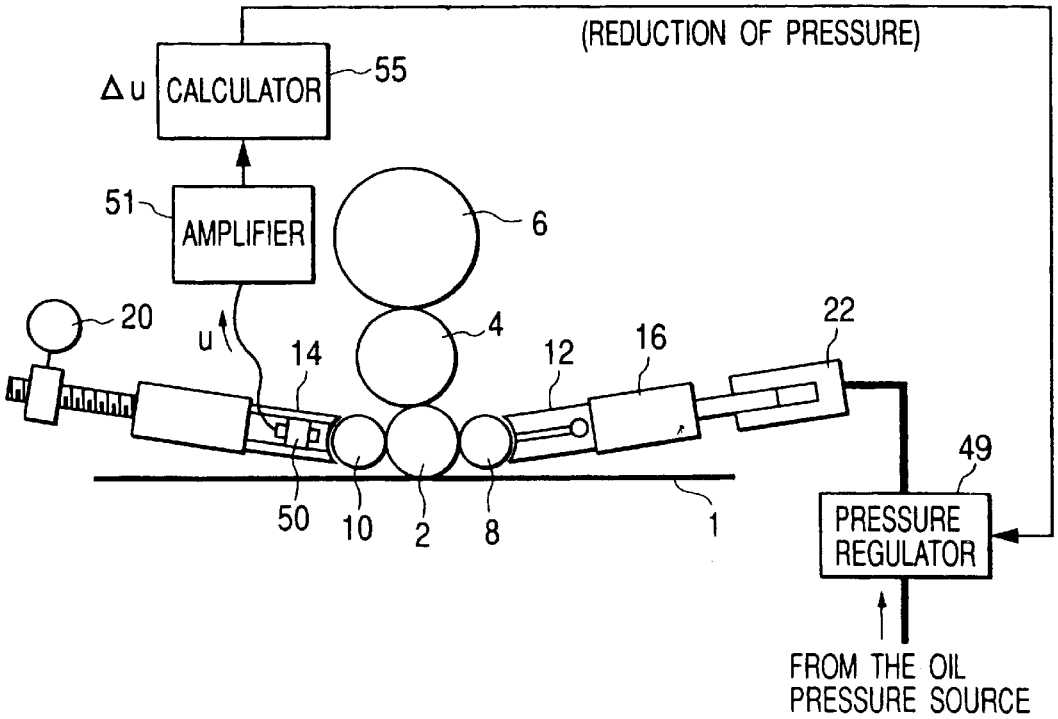
FIG. 12 is a front view showing an upper half of a rolling mill according to the seventh embodiment of the present i ion.

In FIG. 12, the amount of floating, u, of the idler roll 10 in rolling is measured by the gap measuring device 50 disposed within the static pressure bearing 14 and the measured value is converted to an electric signal. The value u thus detected is outputted to a calculator 55, which in turn calculates the difference Δu from the amount of floating,$u_0$, which serves as a reference value, in accordance with the foregoing equation (8). When Δu is a negative value, this indicates that the horizontal force is excessive, so the calculator 55 outputs a pressure reducing signal to the pressure regulator 49 disposed in the oil pressure system for the pushing cylinder 22. The amount of reduction in pressure, Δq,is assumed to take the following value proportional to Δu:

$$\Delta q=\alpha_4 \cdot \Delta u \tag{10}$$

where $\alpha_4$ is a constant. However, when the pushing force is zero, the rolls 2,8 and 10 become unstable positionally, so it is necessary that a limit be placed on Δq lest the pushing force should drop to zero or less due to the pressure reduction based on equation (10). Alternatively, Δq may take a certain constant value.

According to this seventh embodiment described above, not only the same effect as in the first embodiment is obtained, but also, when an excessive force is exerted on the static pressure bearing 14, the horizontal force generated by the pushing cylinder 22 is decreased to diminish the total horizontal force applied to the bearing 14, whereby it is possible to prevent contact and flaws of the roll 10 and the bearing 14.

The eighth embodiment of the present invention will be described below with reference to FIG. 13, which is a top view of the left-hand quadrant in the figure of an upper half of a rolling mill according to the eighth embodiment. In the same figure it is assumed that the side close to the upper end is an operating side, while the side close to the lower end is a driving side. The same components as in the figures referred to previously are indicated by the same reference numerals as in those figures.

Figure 13:
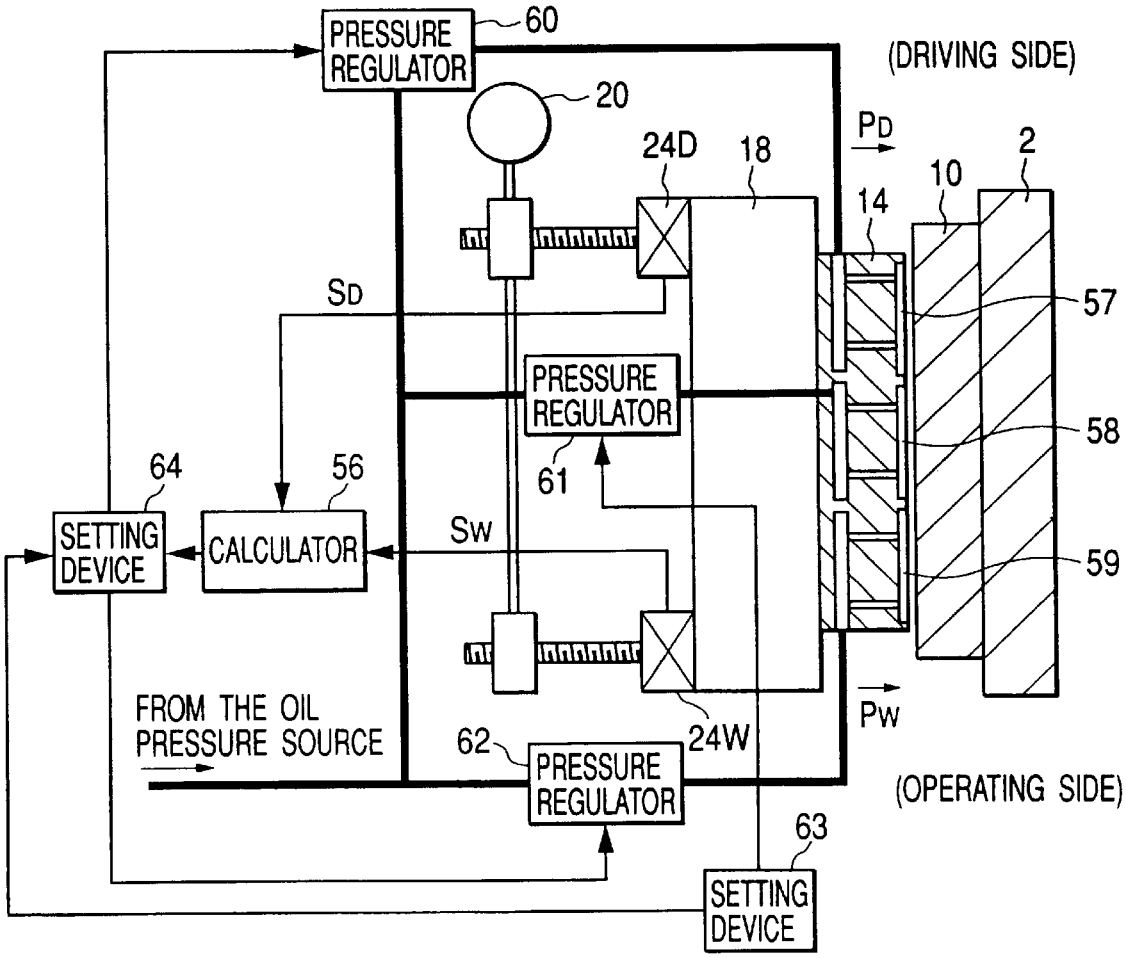
FIG. 13 is a top view of a left-hand quadrant in the same figure of an upper half of a rolling mill according to the eighth embodiment of the present invention.

In FIG. 13, a horizontal force $S_W$ applied to the operating side is detected by a load cell 24W disposed on the operating side, while a horizontal force $S_D$ applied to the driving side is detected by a load cell 24D disposed on the driving side. Both $S_W$ and $S_D$ are fed to a calculator 56, which in turn calculates a difference ΔS between the two in accordance with the following equation:

$$\Delta S=S_W-S_D \tag{11}$$

The static pressure bearing 14 has three oil pockets 57,58 and 59 having respective independent oil pressure systems for floating. Pressure regulators 60, 61 and 62 are disposed respectively in those oil pressure systems, whereby the oil pressures in the oil pockets 57, 58 and 59 can be controlled each independently. A reference pressure in each system is set by a setting device 63. The value of ΔS calculated above is outputted to another setting device 64, and an operating-side system pressure $p_W$ and a driving-side system pressure $p_D$ are determined in the following manner:

When ΔS is positive, $p_W$ is increased because the horizontal force on the operating side is large, while when ΔS is negative, $p_D$ is increased because the horizontal force on the driving side is large. Although it is appropriate to set the amount of increase (decrease) in pressure, Δ p, at a value proportional to the absolute value of ΔS, the value of Δp may be a constant value.

According to this eighth embodiment described above, not only the same effect as in the first embodiment is obtained, but also, when an excessive force is exerted on a certain portion in the plate width direction, the oil pressure fed for floating at that portion of a large horizontal force is increased and hence it is possible to increase the total allowable load imposed on the static pressure bearing 14, whereby it is possible to prevent contact and flaws of the roll 10 and the bearing 14.

The ninth embodiment of the present invention will be described below with reference to FIG. 14, which is a top view of the left-hand quadrant in the figure of an upper half of a rolling mill according to the ninth embodiment. In the same figure it is assumed that the side close to the upper end is an operating side, while the side close to the lower end is a driving side. The same components as in the figures referred to previously are indicated by the same reference numerals as in those figures.

Figure 14:
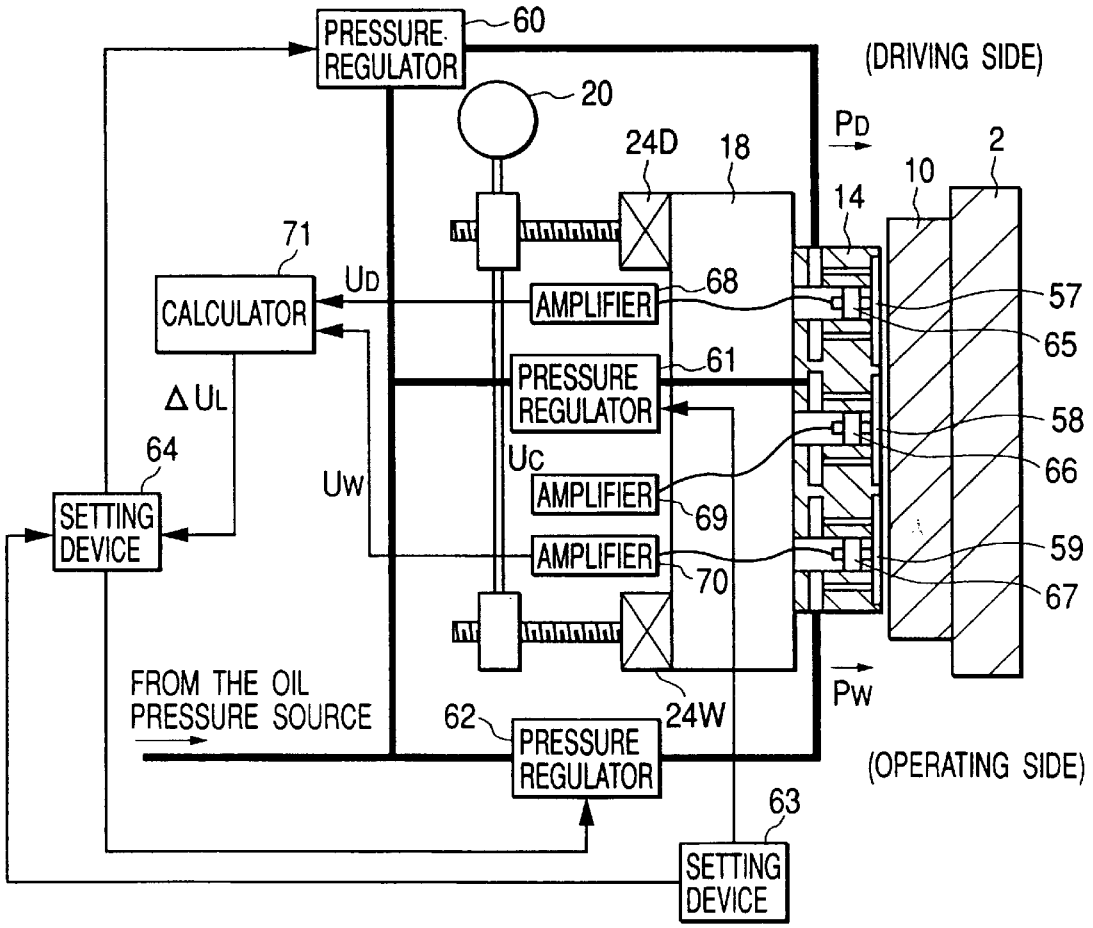
FIG. 14 is a top view of a left-hand quadrant in the same figure of an upper half of a rolling mill according to the ninth embodiment of the present invention.

In FIG. 14, amounts of floating, $u_D$, $u_C u_W$ of the idler roll 10 are measured by gap detectors disposed respectively in the three oil pockets 57,58 and 59 of the static pressure bearing 14, and the measured values are converted to electric signals by means of amplifiers 68,69 and 70. As to the amount of floating, $u_C$, at the central portion, it is the same as that explained above in connection with FIGS. 10 to 12, and the same processing as in the fifth to seventh embodiments is performed. As to the amount of floating, $u_W$ on the operating side and $U_D$ on the driving side, they are inputted to a calculator 71, which in turn calculates a difference $\Delta u_L$ of the two in accordance with the following equation:

$$\Delta u_L=u_W-u_D \tag{12}$$

Three oil pockets 57, 58 and 59 have respective independent oil pressure systems for floating, in which are disposed pressure regulators 60, 61 and 62 respectively, whereby the oil pressures in the oil pockets 57,58 and 59 can be controlled each independently. A reference pressure in each system is set by the setting device 63. The value of $\Delta u_L$ calculated above is outputted by another setting device 64, and both operating side system pressure $p_w$ and driving-side system pressure $P_D$ are determined as follows.

When $\Delta u_L$ is positive, the amount of floating, $u_W$, on the operating side is large and $u_D$ on the driving side is small, so it is indicated that an excessive horizontal force is exerted on the driving side. Therefore, the allowable load on the driving side is increased by increasing $p_D$ Conversely, when $\Delta u_L$ is negative, the amount of floating, $u_W$, on the operating side is small and $u_D$ on the driving side is large, so it is indicated that an excessive horizontal force is exerted on the operating side. Therefore, the allowable load on the operating side is increased by increasing $p_w$. In this case, it is appropriate to set the amount of increase in pressure,Δp, at a value proportional to the absolute value of $\Delta u_L$, but the value of Δp may be a constant value.

According to this ninth embodiment described above, not only the same effect as in the first embodiment is obtained, but also, when an excessive force is exerted on a certain portion in the plate width direction, the oil pressure fed for floating at that portion of a large horizontal force is increased and hence it is possible to increase the total allowable load imposed on the static pressure bearing 14, whereby it is possible to prevent contact and flaws of the roll 10 and the bearing 14.

The tenth embodiment of the present invention will be described below with reference to FIG. 15, which is a top view of an upper half of a rolling mill according to the tenth embodiment. In the same figure it is assumed that the side close to the upper end is an operating side, while the side close to the lower end is a driving side. The same components as in the figures referred to above are indicated by the same reference numerals as in those figures.

Figure 15:
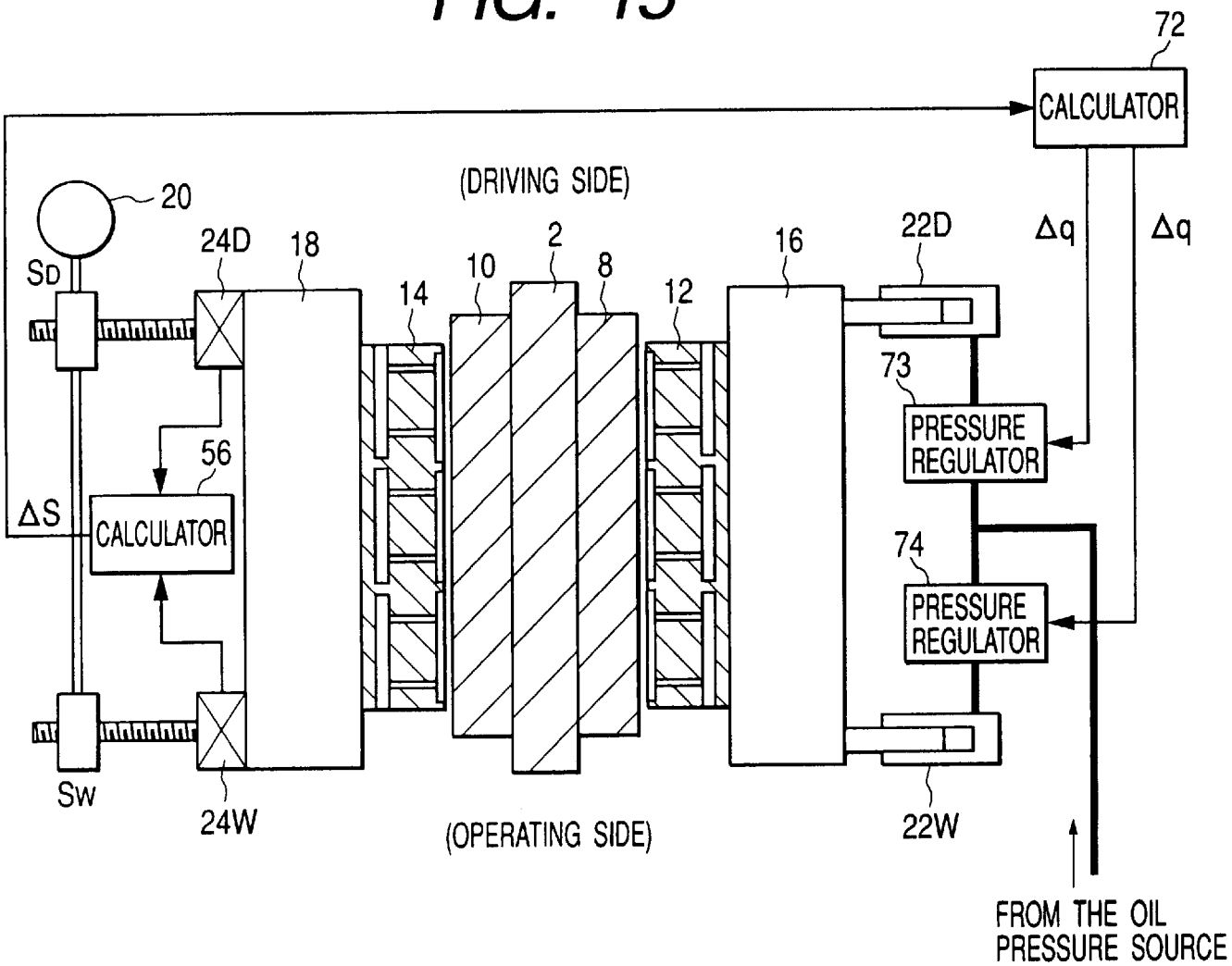
FIG. 15 is a top view of an upper half of a rolling mill according to the tenth embodiment of the present invention.

In FIG. 15, a horizontal force $S_W$ exerted on the operating side is detected by the load cell 24W disposed on the operating side, while a horizontal force $S_D$ exerted on the driving side is detected by the load cell 24D disposed on the driving side. Both $S_W$ and $S_D$ are fed to the calculator 56, which in turn calculates the difference ΔS between the two in accordance with the foregoing equation (11). A calculator 72 receives ΔS and, when ΔS is positive, indicating that the horizontal force $S_W$ on the operating side is larger, provides a pressure reducing signal Δq to a pressure regulator 74 for a pushing cylinder 22W on the operating side, while when ΔS is negative, indicating that the horizontal force $S_D$ on the driving side is larger, provides the pressure reducing signal Δq to a pressure regulator 73 for a pushing cylinder 22D on the driving side. Although it is appropriate to set the amount of reduction in pressure, Δq, at a value proportional to the absolute value of ΔS, the value of Δq may be a constant value. However, if the pushing force is zero, the rolls 2,8 and 10 become unstable positionally, so it is necessary to place a limit on Δq lest the pushing force should drop to zero or less due to the pressure reduction based on Δq.

According to this tenth embodiment described above, not only the same effect as in the first embodiment is obtained, but also, upon exertion of an excessive force on a certain portion in the plate width direction, the pushing force generated by the pushing cylinder is decreased at that portion of a large horizontal force and hence the total horizontal force applied to the static pressure bearing 14 can be diminished, whereby it is possible to prevent contact and flaws of the roll 10 and the bearing 14.

The eleventh embodiment of the present invention will be described below with reference to FIG. 16, which is a top view of an upper half of a rolling mill according to the eleventh embodiment. In the same figure it is assumed that the side close to the upper end is an operating side, while the side close to the lower end is a driving side. The same components as in the figures referred to previously are indicated by the same reference numerals as in those figures.

Figure 16:
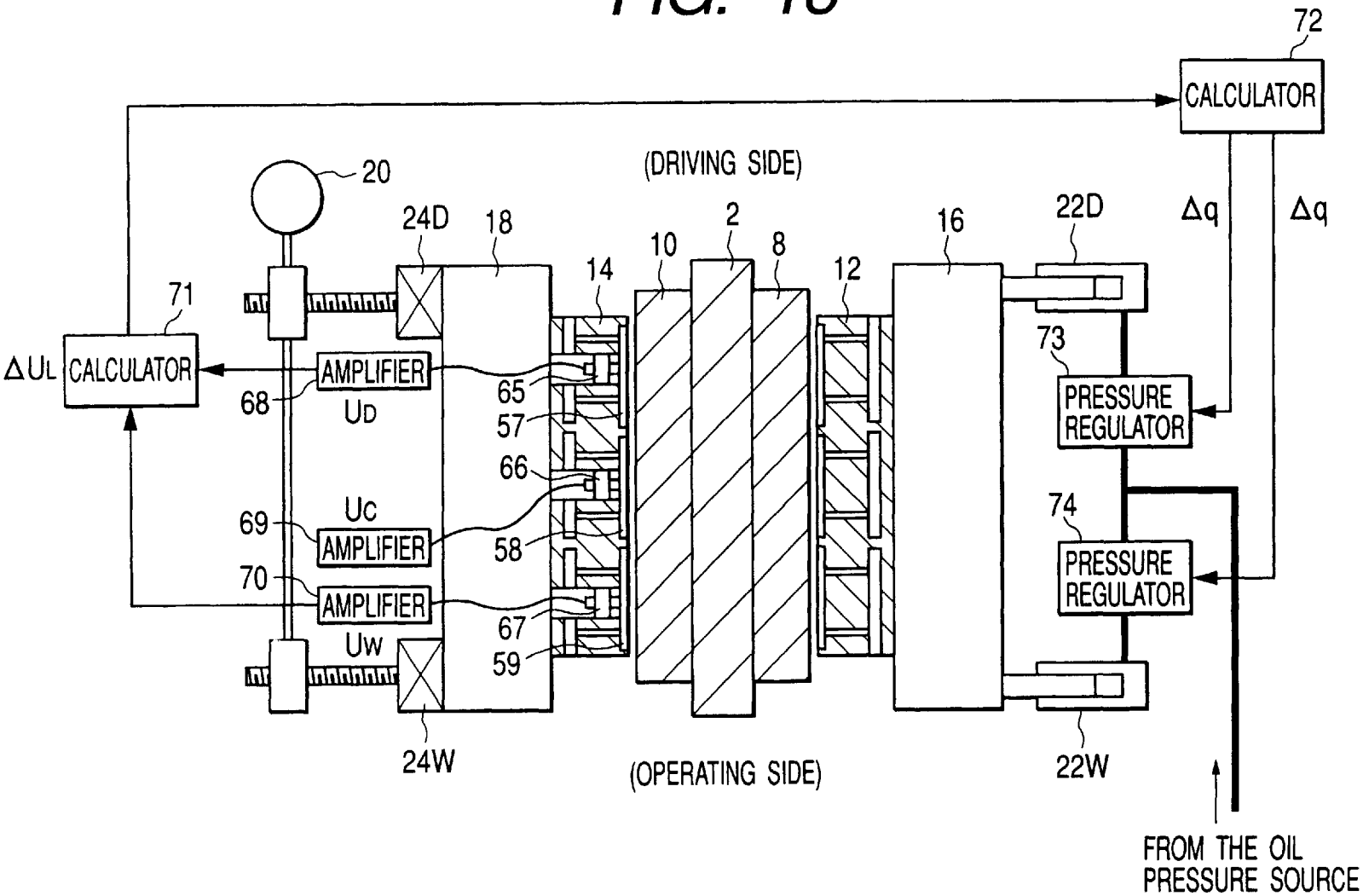
FIG. 16 is a top view of an upper half of a rolling mill according to the eleventh embodiment of the present invention.
Figure 17:
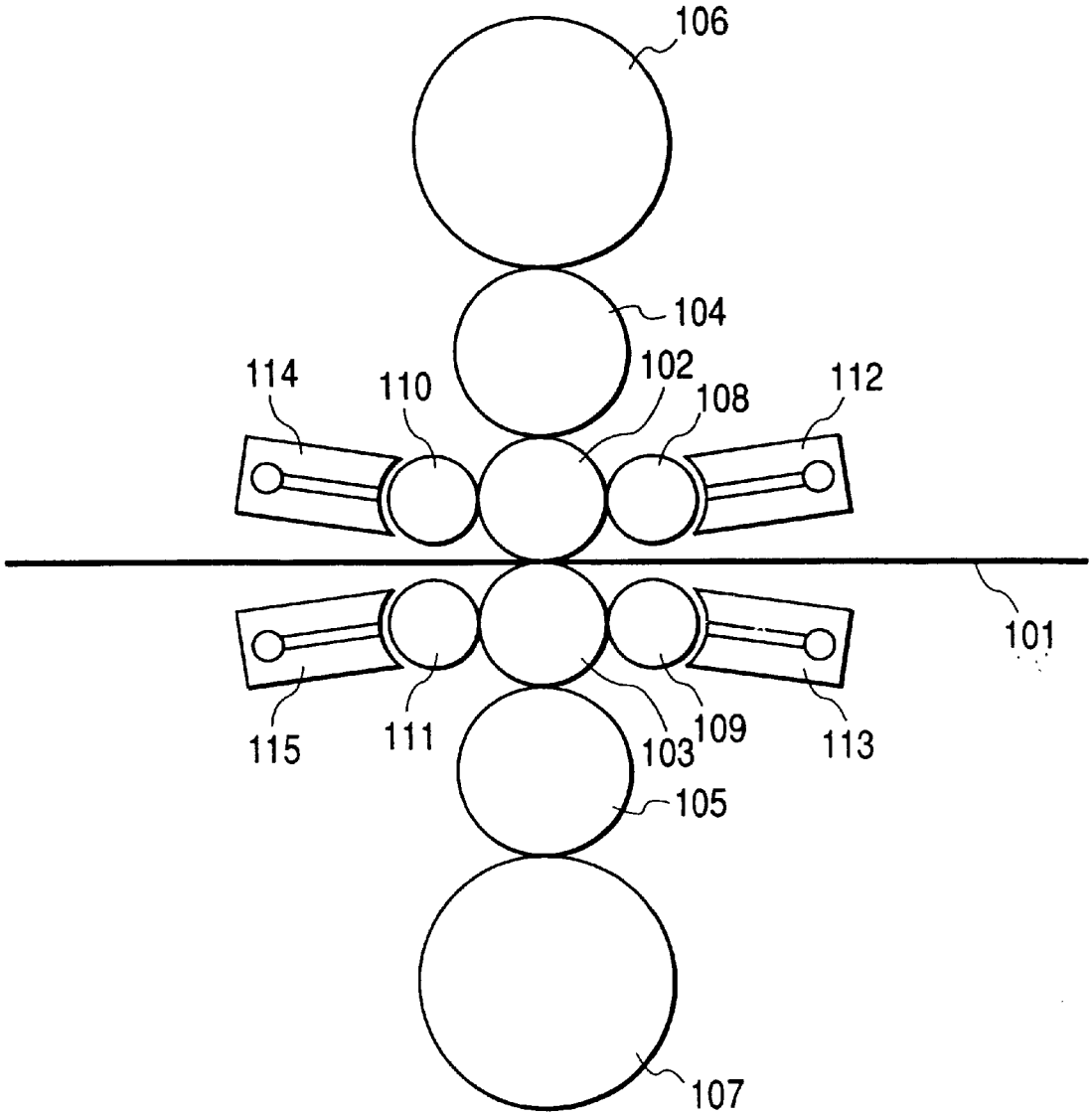
FIG. 17 is a front view showing an example of a conventional rolling mill in which work rolls are supported by static pressure bearings.

In FIG. 16, the amounts of floating, $u_D$, $u_C$, $u_W$ of the idler roller 10 are measured by the gap detectors 65,66 and 67 disposed respectively in the three oil pockets 57,58 and 59 of the static pressure bearing 14 and the measured values are converted to electric signals by the amplifiers 68,69 and 70. As to the amount of floating, $u_C$, at the central portion, it is the same as that explained above in connection with FIGS. 10 to 12, and the same processing as in the fifth to seventh embodiments is performed. As to the amount of floating, $u_W$, on the operating side and $u_D$ on the driving side, they are inputted to the calculator 71, wherein the difference $\Delta u_L$ of the two is calculated in accordance with the foregoing equation (12). The value $\Delta u_L$ thus calculated is provided to a calculator 75. When $\Delta u_L$ is positive, this means that the horizontal force $S_D$ on the driving side is larger, so the calculator 75 provides a pressure reducing signal Δq to the pressure regulator 73 for the pushing cylinder 22D on the driving side, while when $\Delta u_L$ is negative, since this means that the horizontal force $u_W$ on the operating side is larger, the calculator 75 provides the pressure reducing signal Δq to the pressure regulator 74 for the pushing cylinder 22W. Although it is appropriate to set the amount of reduction in pressure, Δq, at a value proportional to the absolute value of $\Delta u_L$ , Δq may be a constant value. However, if the pushing force is zero, the rolls 2,8 and 10 become unstable positionally, so it is necessary to place a limit on Δq lest the pushing force should drop to zero or less due to the reduction of pressure based on Δq.

According to this eleventh embodiment described above, not only the same effect as in the first embodiment is obtained, but also, upon exertion of an excessive force on a certain portion in the plate width direction, the pushing force generated by the pushing cylinder is decreased at that portion of a large horizontal force and hence the total horizontal force applied to the static pressure bearing 14 can be diminished, whereby it is possible to prevent contact and flaws of the roll 10 and the bearing 14.

Although in FIG. 6 and FIGS. 13 to 16 referred to above the number of oil pockets and that of gap detectors are each three for one static pressure bearing, any other number (plural number) of oil pockets may be provided.

According to the rolling mill of the present invention, as set forth hereinabove, when rolling is performed by the rolling mill wherein working rolls are supported horizontally by static pressure bearings, the working rolls are moved horizontally in the incoming and outgoing direction of the rolls by moving means attached to the static pressure bearings, so it becomes possible to prevent an excessive force from being exerted on the bearings and the rolls can be prevented from coming into contact with bearing pads of the static pressure bearings under the action of an excessive horizontal force.

Therefore, the rolls can be prevented from being flawed, the product quality is no longer deteriorated, the lowering of yield can be prevented, and damage to the pads of the static pressure bearings can also be prevented. As a result, it becomes unnecessary to interrupt operation for a long time to replace the damaged pads with fresh pads, whereby it is possible to prevent the deterioration of productivity. Further, since even working rolls of a small diameter are employable stably in the present invention, it becomes possible to roll hard and thin plates efficiently.

What is claimed is:

1. A rolling mill having at least a pair of work rolls for rolling a strip, at least a pair of support rolls for supporting the work rolls vertically, static pressure bearings for supporting said work rolls horizontally over a range not smaller than the maximum width of said strip, said static pressure bearings being disposed on both an incoming side and an outgoing side of the work rolls, and a moving apparatus for moving said work rolls horizontally is attached to said static pressure bearings located on at least one of the incoming side and outgoing side of the work rolls to maintain a horizontal force acting on the work rolls within a predetermined value.

2. A rolling mill according to claim 1, wherein horizontal force measuring means for measuring a horizontal force applied to said static pressure bearings are attached to the static pressure bearings located on at least one of the incoming side and the outgoing side of the work rolls.

3. A rolling mill according to claim 1, wherein said moving means are attached to said static pressure bearings located on either the incoming side or the outgoing side of said work rolls, and pushing force generating means for generating a pushing force which resists the force generated by said moving means are attached to the static pressure bearing located on the other side.

4. A rolling mill according to claim 1, further having floating measuring means for measuring the amount of floating of said work rolls relative to said static pressure bearings, the work rolls being supported by the static pressure bearings.

5. A rolling mill according to claim 2, further having feed pressure control means for controlling a fluid pressure to be fed to said static pressure bearings in accordance with the horizontal force measured by said horizontal force measuring means.

6. A rolling mill according to claim 2, further having static pressure bearing control means for moving each of said static pressure bearings to a position where the horizontal force measured by said horizontal force measuring means is not larger than a predetermined value.

7. A rolling mill according to claim 2, further having moving means control means for controlling said work roll moving means so as to move each of the work rolls to a position where the horizontal force measured by said horizontal force measuring means is of a predetermined value or less.

8. A rolling mill according to claim 1, further having idler rolls disposed between said work rolls and said static pressure bearings.

9. A rolling mill according to claim 1, wherein a plurality of feed holes for the supply of fluid to said static pressure bearings are formed in each of said static pressure bearings so as to be arranged in the strip width direction, said feed holes being varied in diameter in the strip width direction.

10. A rolling method using the rolling mill described in claim 3, comprising: feeding material to be rolled into said rolling mill; measuring a horizontal force applied to said static pressure bearings by said horizontal force measuring means; and controlling the force generated by said pushing force generating means in accordance with the horizontal force thus measured.

11. A rolling method using the rolling mill described in claim 4, comprising: feeding material to be rolled into said rolling mill; measuring the amount of floating of said work rolls relative to said static pressure bearings by said floating measuring means; and controlling the position of the work rolls in the roll incoming and outgoing direction in accordance with the amount of floating thus measured.

12. A rolling method using the rolling mill described in claim 4, comprising: feeding material to be rolled into said rolling mill; measuring the amount of floating of said work rolls relative to said static pressure bearings by said floating measuring means; and controlling the force generated by said pushing force generating means in accordance with the amount of floating thus measured.

13. A rolling method using the rolling mill described in claim 4, comprising: feeding material to be rolled into said rolling mill; measuring the amount of floating of said work rolls relative to said static pressure bearings by said floating measuring means; and controlling the pressure of fluid fed to the static pressure bearings in accordance with the amount of floating thus measured.

14. A rolling method using the rolling mill described in claim 3, comprising: feeding material to be rolled into said rolling mill; measuring, on both operating side and driving side, a horizontal force applied horizontally to said static pressure bearings by said horizontal force measuring means; and controlling the difference between the operating side and the driving side in the pressure of fluid fed to the static pressure bearings in accordance with the difference between the horizontal force measured on the operating side and the horizontal force measured on the driving side.

15. A rolling method using the rolling mill described in claim 3, comprising: feeding material to be rolled into said rolling mill; measuring, on both operating side and driving side, a horizontal force applied horizontally to said static pressure bearings by said horizontal force measuring means; and controlling the difference between the operating side and the driving side in the force generated by said pushing force generating means in accordance with the difference between the horizontal force measured on the operating side and the horizontal force measured on the driving side.

16. A rolling method using the rolling mill described in claim 4, comprising: feeding material to be rolled into said rolling mill; measuring the amount of floating of said work rolls relative to said static pressure bearings at least two points in the plate width direction by said floating measuring means; and controlling the difference between the operating side and the driving side in the pressure of fluid fed to the static pressure bearings in accordance with the difference between the operating side and the driving side in the amount of floating thus measured.

17. A rolling method using the rolling mill described in claim 4, comprising: feeding material to be rolled into said rolling mill; measuring the amount of floating of said working rolls relative to said static pressure bearings at least two points in the plate width direction by said floating measuring means; and controlling the difference between the operating side and the driving side in the force generated by said pushing force generating means in accordance with the difference between the operating side and the driving side in the amount of floating thus measured.

18. A rolling mill according to claim 2, wherein said moving means are attached to said static pressure bearings located on either the incoming side or the outgoing side of said work rolls, and pushing force generating means for generating a pushing force which resists the force generated by said moving means are attached to the static pressure bearing located on the other side.

19. A rolling mill according to claim 2, further having floating measuring means for measuring the amount of floating of said work rolls relative to said static pressure bearings, the work rolls being supported by the static pressure bearings.

20. A rolling mill according to claim 3, further having floating measuring means for measuring the amount of floating of said work rolls relative to said static pressure bearings, the work rolls being supported by the static pressure bearings.

21. A rolling mill according to claim 3, further having feed pressure control means for controlling a fluid pressure to be fed to said static pressure bearings in accordance with the horizontal force measured by said horizontal force measuring means.

22. A rolling mill according to claim 4, further having feed pressure control means for controlling a fluid pressure to be fed to said static pressure bearings in accordance with the horizontal force measured by said horizontal force measuring means.

23. A rolling mill according to claim 2, further having idler rolls disposed between said work rolls and said static pressure bearings.

24. A rolling mill according to claim 3, further having idler rolls disposed between said work rolls and said static pressure bearings.

25. A rolling mill according to claim 4, further having idler rolls disposed between said work rolls and said static pressure bearings.

26. A rolling mill according to claim 5, further having idler rolls disposed between said work rolls and said static pressure bearings.

27. A rolling mill according to claim 6, further having idler rolls disposed between said work rolls and said static pressure bearings.

28. A rolling mill according to claim 7, further having idler rolls disposed between said work rolls and said static pressure bearings.

* * * * *